United States Patent [19]

Johnson

[11] 4,270,505

[45] Jun. 2, 1981

[54] FUEL VAPORIZER SYSTEM

[75] Inventor: Randall W. Johnson, Hurst, Tex.

[73] Assignee: Auto-Miser International Manufacturing Corp., Richardson, Tex.

[21] Appl. No.: 21,259

[22] Filed: Mar. 16, 1979

[51] Int. Cl.[3] ..... F02M 17/22

[52] U.S. Cl. ..... 123/522; 123/523

[58] Field of Search ..... 123/133, 134, 119 B, 123/522, 523, 524, 572, 573; 261/121 A, 121 B, 119 A, 122, 123

[56] References Cited

U.S. PATENT DOCUMENTS

| | | | |
|---|---|---|---|
| 46,432 | 2/1865 | Buckland | 123/133 |
| 55,778 | 6/1866 | Messenger | 123/133 |
| 135,806 | 2/1873 | Holmes | 123/133 |
| 306,924 | 10/1884 | Hopkins | 123/133 |
| 420,591 | 2/1890 | Dawson | 123/133 |
| 528,882 | 11/1894 | Keller | 123/133 |
| 1,365,651 | 1/1921 | Beumont | 123/133 |
| 2,461,411 | 2/1949 | Cummings | 123/522 |
| 3,411,489 | 11/1968 | Kruger | 123/133 |
| 3,557,763 | 1/1971 | Probst | 123/134 |
| 4,031,874 | 6/1977 | Alwine | 123/133 |
| 4,046,119 | 9/1977 | Perry | 123/134 |
| 4,175,525 | 11/1979 | Johnson | 123/522 |

*Primary Examiner*—Ronald H. Lazarus

*Attorney, Agent, or Firm*—Kanz & Timmons

[57] ABSTRACT

Disclosed is a fuel vaporizer system for forming a mixture of vaporized fuel and air and injecting the mixture into the intake manifold of a spark ignition internal combustion engine. The vaporizer unit includes a canister containing a controlled liquid level of fuel and a foraminous body partially submerged in the liquid fuel to promote rapid vaporization of the fuel. The canister contains a dividing wall above the foraminous body so that air drawn into the canister must pass through the foraminous body and mix with the vaporized fuel. The vaporization unit functionally parallels the conventional carburetor and includes means to control the flow of gas through the vaporizer and control the pressure in the intake manifold.

14 Claims, 1 Drawing Figure

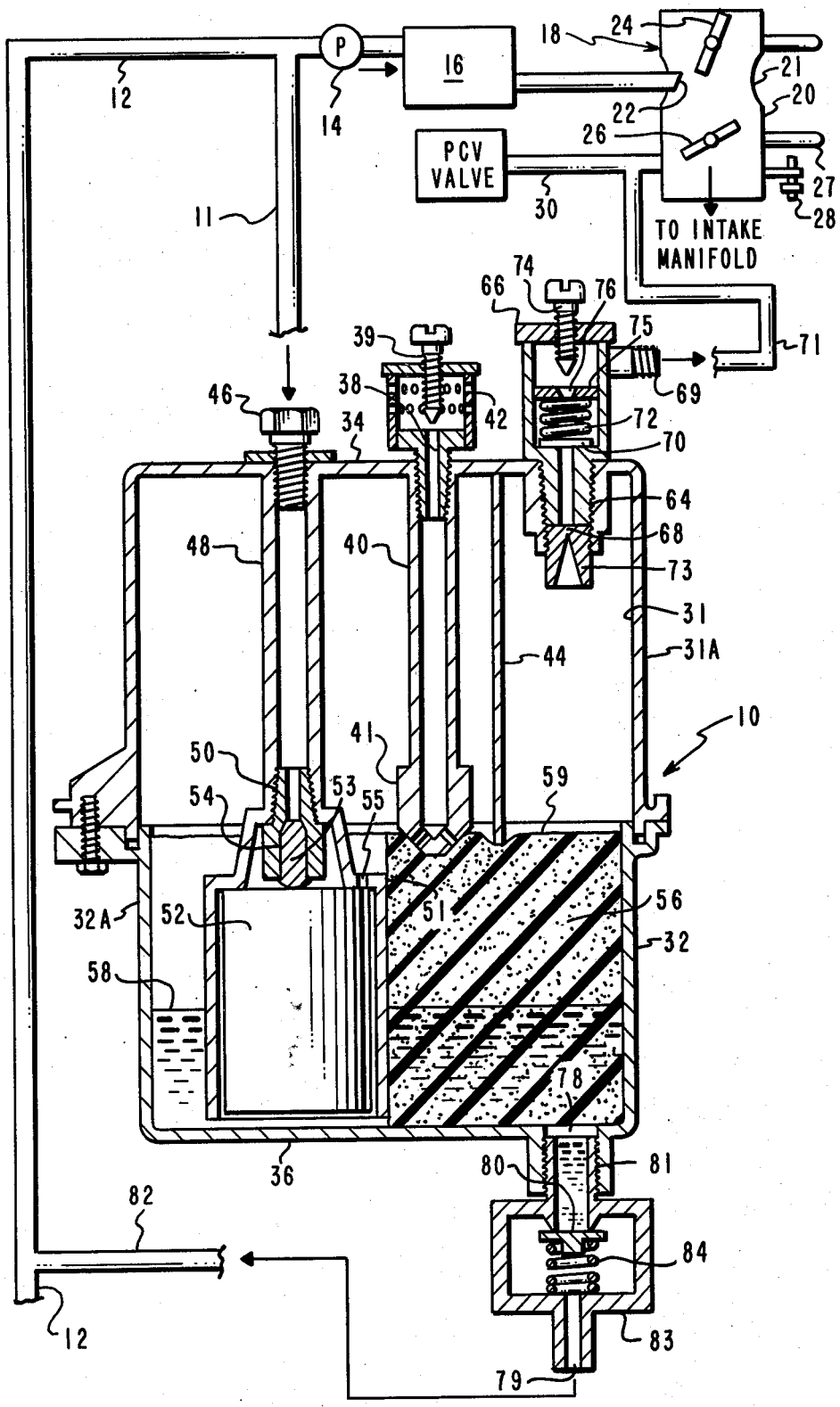
P
16
PCV VALVE
TO INTAKE MANIFOLD
10
11
12
14
18
20
21
22
24
26
27
28
30
31
31A
32
32A
34
36
38
39
40
41
42
44
46
48
50
51
52
53
54
55
56
58
59
64
66
68
69
70
71
72
73
74
75
76
78
79
80
81
82
83
84

FUEL VAPORIZER SYSTEM

This invention relates to carburetion systems for spark ignition internal combustion engines. More particularly, it relates to apparatus for forming a mixture of vaporized fuel and air and injecting the mixture into the intake manifold of an internal combustion engine at a point between the carburetor and the distribution branches of the intake manifold.

Conventional spark ignition internal combustion engines employ an air and fuel mixing and distribution system comprising a carburetor for mixing air and fuel and an intake manifold for distributing the mixture to the combustion cylinders. A combustible fuel and air mixture is formed in the carburetor by drawing air through a venturi where fuel is drawn into and mixed with the air. It is well known that the fuel and air mixture formed in conventional carburetors, however, is not an ideal mixture since the fuel is sprayed into an air stream in the form of a mist or small droplets. It is also well known that the efficiency of an internal combustion engine, i.e., the amount of work produced in terms of fuel consumed, is partially dependent upon the degree to which the fuel is dispersed in the air. Therefore, if the fuel is completely vaporized prior to injection into the combustion chamber of the engine, combustion thereof is more complete, thus resulting in higher efficiency. Furthermore, more complete combustion of the fuel lowers the concentration of hydrocarbon (HC) and carbon monoxide (CO) emissions from the engine.

In view of the scarcity and ever-increasing cost of hydrocarbon fuels and governmental regulations limiting the permissible emissions from internal combustion engines used in automobiles and the like, various systems have been devised which attempt to lower emissions and/or increase efficiency in internal combustion engines. Techniques for lowering emissions have been primarily directed to systems such as catalytic converters or air injector reactor systems and the like for removing toxic or otherwise undesirable emissions from the exhaust. Such systems produce no useful work and therefore do not increase efficiency. On the contrary, such systems as the air injector reactor systems require an air pump which is driven by the engine, thus further lowering the amount of useful work available from the engine.

In some modern engines attempts have been made to lower the emission of nitrogen oxides by introducing exhaust gas into the intake manifold, thereby lowering combustion temperatures and lowering the concentration of nitrogen oxides formed. However, introduction of an essentially inert gas into the intake manifold detrimentally affects the power output of the engine, thus lowering fuel efficiency. Thus, most conventional techniques for lowering emissions also reduce the efficiency of the engine and thus detrimentally affect fuel economy and available power.

In accordance with the present invention, a fuel vaporization system is provided which operates in parallel with a conventional carburetor to inject a mixture of vaporized fuel and air directly into the intake manifold downstream from the carburetor. The fuel vaporizer system of the invention provides a mixture in which fuel is completely vaporized, thereby assuring more complete combustion of fuel which in turn promotes better fuel economy and lowers undesirable hydrocarbon and carbon monoxide emissions. The apparatus of the invention may be readily installed on conventional internal combustion engines without major modification of the conventional fuel supply system and, in accordance with the invention, can be made completely fail-safe and collision-proof so as to eliminate any additional fire or escaped fuel hazards in the event of a collision or upset of the automobile. Furthermore, the apparatus may be made from readily available materials and is extremely simple in design, thus permitting easy and ready fabrication and installation thereof. When properly installed, the system of the invention controls undesirable pressure variations in the intake manifold so as to insure proper functioning of associated PCV systems.

In accordance with the invention, a fuel vaporizer is installed in the fuel distribution system functionally parallel with the carburetor. The fuel vaporizer comprises a canister into which the flow of fuel is controlled by a float valve to maintain a pre-selected level of liquid fuel. A foraminous material with a high ratio of surface area to volume, such as a body of polyurethane foam, is disposed in the canister and the level of liquid fuel maintained below the top surface of the foraminous body. The foraminous body acts as a wick to promote vaporization of the fuel into air drawn therethrough. Air is drawn into the vaporizer and through the foraminous body above the liquid level to be mixed with the vaporized fuel. The fuel/air mixture is withdrawn from the vaporizer and injected into the intake manifold downstream from the carburetor throttle valve. Since the air is never mixed with liquid fuel, droplets of fuel cannot be entrained in the air drawn from vaporizer system. Accordingly, the fuel/air mixture withdrawn from the vaporizer contains only fully vaporized fuel. The inlets and outlet from the vaporizer are appropriately positioned and valved to prevent loss of fuel from the vaporizer in case of collision or upset of the automobile and flow of gas through the vaporizer is controlled to insure only a predetermined pressure change in the intake manifold, thereby avoiding adversely affecting other associated systems. Other features and advantages of the invention will become more readily understood when taken in connection with the appended claims and attached drawings in which the sole figure is a partially sectional and partially schematic view of the preferred embodiment of the invention.

As illustrated in the drawing the vaporization system of the invention comprises a fuel vaporizing unit generally indicated at 10 connected operationally parallel with the carburetor and fuel pump between the fuel supply line 12 and the intake manifold of an internal combustion engine. For illustrative purposes, the conventional fuel distribution system of an internal combustion engine is illustrated schematically comprising a fuel line 12 for conducting fuel from a fuel tank (not shown) through a pump 14 into a float valve controlled reservoir 16 in a carburetor generally indicated at 18. As illustrated, the carburetor 18 comprises a barrel 20 with a venturi 21 therein. The exit end of barrel 20 is attached to the intake manifold. Fuel is drawn into the venturi through jet 22. The conventional carburetor usually includes a choke valve 24 upstream from jet 22 and a throttle valve 26 downstream from jet 22. Engine speed is normally controlled by throttle valve 26 which is linked to a throttle control means by lever 27. Normally, the minimum closure of throttle valve 26 is controlled by an idle adjustment screw 28.

To control crankcase emissions from blow-by and the like modern internal combustion engines employ a positive crankcase ventilation (PCV) system. In essence the PCV system comprises a conduit 30 connected between the crankcase and the intake manifold at a point downstream from the throttle valve so that vapors are drawn from the crankcase through the conduit 30 into the intake manifold. To maintain the desired pressure differential between the crankcase and the intake manifold and to prevent gas from entering the crankcase in case of backfiring, etc., the vent through which the crankcase communicates with the conduit 30 is controlled by a spring loaded combination check valve and metering valve commonly known as a PCV valve.

In the preferred embodiment of the invention, the vaporizer 10 comprises a cylinder canister comprised of two mating halves. The top half 31 and bottom half 32 are joined to form a sealed enclosure having a top wall 34 and a bottom wall 36 joined by side walls 31A and 32A.

As illustrated in the drawing top wall 34 is provided with an aperture 38 which communicates with an air conduit 40. Air conduit 40 depends internally from the top wall 34 and, in the preferred embodiment, terminates in a nozzle 41 having a plurality of small holes therein so that air drawn through nozzle 41 is turbulently injected into the interior of the canister. Conduit 40 may be formed as an integral part of top wall 34 or secured within a depending boss. In any event, conduit 40 should provide leak-proof means for conducting air which enters through the aperture 38 to a point within the interior of the canister which is substantially removed from the top wall 34 but also well above the level of liquid fuel.

In the preferred embodiment the nozzle 41 is submerged in a foraminous body 56 disposed in the bottom half 32 of the canister so that incoming air is forced directly into the foraminous material. If desired, aperture 38 may be provided with a suitable filter 42 through which air is conducted into the aperture 38. Alternatively, the aperture 38 may communicate with a hose (not shown) communicating with the conventional air filter housing providing filtered air to the inlet of the carburetor. If desired, the inlet air may be pre-warmed by conventional means.

Vaporizer unit 10 is provided with a fuel inlet 46 which communicates with a internally downwardly depending fuel conduit 48. In the preferred embodiment fuel conduit 48 is integrally formed as a part of top wall 34 and extends a substantial distance within the enclosure. The lower end of fuel conduit 48 is internally threaded to receive a valve seat 50 having an outwardly diverging outlet 54. A cylindrical cage 51 depends from fuel conduit 48 to a point near the internal surface of bottom wall 36. A cylindrical float 52 is contained within the cage 51.

A free floating needle valve 53 adapted for vertical reciprocal movement in the outlet 54 of the valve seat 50 is supported by the float 52. The float 52 is preferrably a cylindrical body with external dimensions substantially conforming to the internal dimensions of the cage 51 and loosely contained therein so that float 52 may move vertically within the cage 51. Accordingly, when float 52 is in the lowered position needle valve 53 moves downwardly to permit fuel to flow through valve seat 50 into the cage 51 and out through the bottom of the cage into the interior of the canister. As the liquid level rises, float 52 rises and thereby raises needle valve 53 to seat in the valve seat 50 and thereby prevent entry of fuel into the canister when the pre-selected fuel level is achieved. An aperture 55 is provided in the top of cage 51 to permit pressure equalization on both ends of the cylindrical float 52. It will thus be observed that the float 52 cooperates with needle valve 53 to control the level of liquid fuel within the canister.

A body of free-standing foraminous material 56 is disposed within the bottom half of the canister. The body 56 covers a substantial portion of the bottom wall 36. However, the body 56 should cover less than the full internal surface of the bottom wall 36 as will be explained hereinafter.

In the preferred embodiment the body 56 is free standing body of highly porous material which is inert to fuel. Polyurethane foam of about 50% density or less and having about twenty pores per cubic inch has been found to be an acceptable foraminous material. In the preferred embodiment the polyurethane foam is disposed within the bottom of the canister and surrounds the cage 51 so that the entire surface of the bottom wall 36 is covered with the foraminous material except a relatively small portion between the cage 51 and the side wall 32A.

The float 52 and needle valve 53 are adjusted to maintain the maximum liquid level in the canister well below the top surface of the foraminous body 56. As indicated in the drawing, the surface of the liquid level 58 is maintained at approximately one-third to one-half the height of the foraminous body 56. Because the foraminous body 56 is highly porous and has a high ratio of surface area to volume, the foraminous body acts as a wick and thus the fuel travels to the top surface 59 by surface phenomena such as capillary action and is readily vaporized. The entire surface of the bottom wall 36, however, cannot be covered with the wicking material since the pressure in the interior of the canister will be less than atmospheric. Accordingly, equalization of pressure on both the upper and lower sides of the foraminous body must be permitted to prevent the formation of a pool of liquid fuel on the top surface of the foraminous body 56. To provide pressure equalization, a small portion of the top surface 58 of the liquid fuel must be exposed to the interior of the canister. Accordingly, in the preferred embodiment the foraminous body 56 is trimmed so that a small area between the cage 51 and wall 32A is not covered with the foraminous material. Therefore, the pressure at the surface 58 of the liquid will be the same as the pressure in the remainder of the canister. Fuel may thus rise by wicking action through the body 56 and be readily vaporized in and above the foraminous material without the air contacting a liquid surface except in a small area required for pressure equalization.

To permit even distribution of liquid fuel on the bottom of the canister, the bottom wall 36 may be provided with short stand-off bosses or the like (not shown) to raise the foraminous body 56 slightly above the floor of the canister.

An outlet 64 is provided in top wall 34 to permit the mixture of air and vaporized fuel to be withdrawn from the vaporizer 10. As illustrated in the drawing, outlet 64 is provided with a check valve contained in housing 66. In the preferred embodiment the check valve comprises a housing 66 with an inlet 68 and an outlet 69. Inlet 68 threadedly engages outlet 64 to form a sealed connection therewith and provide fluid communication between the interior of vaporizer unit 10 and the interior of the check valve housing 66. Inlet 68 is blocked by a disc 70 which is held in place by coil spring 72. It will thus be observed that disc 70 totally obstructs the inlet 68 to prevent flow of any fluid into vaporizer 10 by way of housing 66 but allows flow in the opposite direction when the pressure differential across disc 70 is sufficient to overcome spring 72.

Housing 66 contains a dividing wall 75 between inlet 68 and outlet 69. The dividing wall 75 contains a single aperture 76 controlling fluid flow through the housing 66. An adjustment screw 74 projecting through the top wall of the housing 66 serves to partially obstruct aperture 76 to control the pressure in the intake manifold as will be explained hereinbelow.

Outlet 69 is connected to the intake manifold downstream from the throttle valve 26 by conduit 71. This connection may be conveniently made by connecting conduit 71 with the PCV conduit 30 between the PCV valve and the intake manifold. Thus the vaporized fuel and air mixture will be diluted with warm air drawn from the crankcase and injected directly into the intake manifold. Mixing the vapors with warm air insures that the vapors will be further diluted and will not form unwanted droplets.

A dividing wall 44 is positioned vertically in the top half of the canister and extends from the top wall 34 to the top surface 59 of the foraminous material 56. The dividing wall 44 is positioned between the air inlet nozzle 41 and the outlet 64, thus dividing the top half of the vaporizer into two compartments and forcing all air passing through the vaporizer to pass through the foraminous material 56 above the liquid level 58. Since the foraminous material acts as a wick, and since the interior of the vaporizer is maintained at a negative pressure, the liquid fuel readily disperses throughout the foraminous material and is easily vaporized by the air passing therethrough. Thus a high concentration of fully vaporized fuel may be mixed with the air without forming liquid droplets. Because of the reduced pressure and the high surface area of the foraminous material, rapid and uniform vaporization is promoted without entraining droplets of liquid fuel in the air.

To further insure that only fully vaporized fuel is withdrawn from the canister, inlet 68 carries a screen or filter plug 73. In the preferred embodiment filter 73 is a plug formed of highly porous material such as bronze sponge or the like. Gasses may therefore be readily drawn therethrough. However, the bronze sponge effectively filters and removes liquid droplets which may have formed in the vaporized fuel and air mixture.

Bottom wall 36 of the vaporizer unit 10 is provided with a liquid outlet 81 to permit liquid fuel to be withdrawn from the vaporizing unit. As illustrated in the drawing, outlet 81 is provided with a housing 83 having an inlet 78 and an outlet 79. Outlet 79 is connected by way of conduit 82 to the fuel line 12 on the low pressure side of pump 14. Inlet 78 threadedly engages outlet 81 to form a sealed connection therewith and provide fluid communication between the interior of vaporizer unit 10 and the interior of the check valve housing 83. Inlet 78 is controlled by a check valve 80 which is held in position to obstruct inlet 78 by coil spring 84. It will thus be observed that check valve 80 permits fluid to flow from the interior of the canister only when the pressure in the canister is sufficient to overcome spring 84.

During operation of the engine the pressure in the canister is always negative. Therefore valve 80 remains closed. However, when the engine is stopped and the pressure in the canister rises to atmospheric, the weight of any excess liquid fuel on the check valve 80 is sufficient to open the valve and permit at least part of liquid fuel to drain from the canister into the fuel reservoir via line 82. In this manner the liquid fuel is always partially drained from the canister at the end of each operation of the engine to prevent the formation of sludge and condensates in the canister. Furthermore, automatic partial draining of the canister insures that low volatility fuel components may not accumulate in the canister and the canister therefore always contains a predetermined volume of fresh fuel of high volatility which may be readily vaporized. To insure that the fuel drains from the canister by gravity, the canister 10 must, of course, be mounted above the level of the fuel reservoir.

It will be observed that the fuel inlet 46 is also connected to the low pressure side of the pump 14 via line 11. Accordingly, fuel is not pumped from the fuel tank into the canister 10 by pump 14. Instead, fuel may be drawn into the canister only when the pressure in the canister is reduced below atmospheric and fuel drawn into the canister by the resulting vacuum. Fuel cannot be drawn into the canister unless the engine is operating and developing sufficient manifold vacuum to open check valve disc 70 and draw fuel from the fuel supply line 12 into the canister. Accordingly, to maintain sufficient vacuum in the canister the flow of air into the canister through air inlet aperture 38 must be controlled.

To control the pressure in the canister, aperture 38 in the air inlet is partially obstructed by an adjustment screw 39. Adjustment screw 39 projects throught the housing supporting filter 42 and is adjusted to limit the flow of air through aperture 38. In the preferred embodiment, screw 39 is adjusted to maintain a reduced pressure in the canister of about two and one-half inches of mercury under normal operating conditions. This reduced pressure is sufficient to draw fuel into the canister and maintain a relatively constant supply of fuel during operation. When the desired level of fuel is obtained in the canister, float 52 rises causing needle valve 53 to block fuel inlet 48.

Air drawn through nozzle 41 passes directly through the foraminous material 56 and the fuel/air mixture formed is then drawn through filter 73 and injected into the intake manifold. As the liquid fuel level in the canister is lowered, float 52 is lowered and needle valve 53 opens to permit fresh fuel to be injected into the canister.

It will be noted that the fuel vaporizer system operationally parallels carburetor 18 and injects vaporized fuel into the intake manifold downstream from the throttle valve 26. Therefore, adjustment of the idle screw 28 may be necessary to obtain the desired idle speed of an engine equiped with a vaporizer system of the invention. Also the fuel and air mixture provided by the carburetor may be adjusted to provide an appropriately lean mixture since additional fuel is introduced downstream from the carburetor venturi by the vaporizer system.

In the preferred embodiment, the canister 10 is formed from mating halves 31 and 32 hermetically sealed by tongue and groove connections as illustrated. Accordingly, when the canister is assembled, the tongue and groove connection is hermetically sealed and permanently joined to form an enclosed container approximately 4.175 inches in diameter and 4.75 inches high. The container is sealed to form a totally leakproof container which is tamper-proof and maintains the internal parts in a permanent relationship. Float 52 is allowed approximately 0.03 inches of travel between the full open and closed positions, thus permitting a maximum of approximately three ounces of liquid fuel in the container. Approximately 16.7 cubic inches of vaporized fuel and air may be maintained within the container above the liquid.

The tension of spring 72 in housing 66 must be sufficient to maintain the check valve disc 70 in the closed position until the desired pressure differential thereacross is developed. In the preferred embodiment, spring 72 maintains the check valve closed until a vacuum of one and one-half inches of mercury is developed in check valve housing 66. It will thus be observed that until a vacuum of one and one-half inches of mercury is developed, the conventional carburetion system operates in the conventional manner. However, when a vacuum in excess of one and one-half inches of mercury is obtained, the check valve opens and permits vaporized fuel and air to be drawn from the vaporizer into the intake manifold.

The required operating pressure differential of the check valve disc 70 provides an essential safety feature of the invention. It will be observed that needle valve 53 closes against valve seat 50 when approximately three ounces of liquid fuel is in the canister. Therefore the maximum amount of liquid in the canister at any time is approximately three ounces. In the event the vehicle is which the vaporization unit of the invention employed is involved in a collision or upset and the vaporizer unit 10 inverted, the three ounces of liquid fuel in the container cannot develop sufficient hydrostatic pressure to open check valve disc 70. Accordingly, all the fuel in vaporizer 10 is contained within the vaporizer and cannot escape to cause a lost fuel hazard. It should also be noted that fuel conduit 48 forms a closed conduit which extends from inlet 46 to valve seat 50 and that valve seat 50 is spaced a substantial distance from the side walls and from the top wall 34. Accordingly, in case of upset in which the vaporizer unit 10 is inverted and the fuel conduit 12 is ruptured, liquid fuel cannot escape from the vaporizer by way of the fuel inlet since the valve seat 50 is well above the liquid level of any fuel contained in the vaporizer. Furthermore, with only three ounces of liquid fuel in the container at any time, nozzle 41 on the air inlet will be well above the level of any liquid in the container whenever the vaporizer unit is in any position. Therefore, since the vaporizer unit is hermetically sealed, all possibility of escape of liquid fuel from the vaporizer is eliminated.

It will be readily recognized that the dimensional character of the vaporization unit may vary within limits according to the size of the internal combustion engine with which it is employed. It has been discovered, however, that a vaporization unit of the dimensions described herein operates effectively when used in connection with internal combustion engines ordinarily used in automotive vehicles. Maximum efficiency of the vaporization system is obtained when a manifold pressure of about eighteen to twenty inches of mercury is obtained.

Since the outlet 69 from the vaporizer communicates with the PCV conduit 30, and since the operation of the PCV valve is partially dependent on manifold vacuum, injection of gas from the vaporizer in quantities sufficient to significantly reduce manifold vacuum at engine operating conditions can adversely affect the operation of the PCV system. In fact, if injection of gas into the conduit 30 is uncontrolled, the pressure on the PCV valve will rise and cause the PCV valve to fully open; resulting in injection of a very lean mixture into the intake manifold. Accordingly, to control the pressure in conduit 30 so as to avoid adversely affecting the normal operation of the PCV system, an adjustment screw 74 is provided to restrict the flow of gas from the vaporizer.

In the preferred method of operation, the vaporizer is installed as described hereinabove but without connection to the fuel line. Instead, the fuel inlet is open to atmosphere and the engine operated at normal idle speed. Screw 74 is then advanced into aperture 76 to completely block flow of air through the vaporizer. The adjustment screw 74 is then retracted to permit limited flow of air through aperture 76 until manifold pressure at the intake manifold under idle conditions is increased (vacuum reduced) by no more than about four inches of mercury. The drop of no more than about four inches of mercury in manifold vacuum is not sufficient to adversely affect normal operation of the PCV valve but provides sufficient vacuum to operate the vaporizer. The fuel lines are then connected to the vaporizer and the engine again operated at normal idle speed. Adjustment screw 39 is then advanced to partially obstruct aperture 38 and limit the flow of air therethrough until a vacuum of about two and one-half inches of mercury is maintained in the vaporizer.

Although the flow of air through the vaporizer will vary with varying engine speeds, the vacuum of approximately two and one-half inches of mercury will remain relatively constant. Since the outlet aperture 76 is adjusted to a fixed size, the manifold vacuum may vary but the drop in manifold vacuum will be no more than about four inches of mercury at any time. When the throttle is opened and the manifold vacuum normally decreases (as at normal operating speeds), the drop in manifold vacuum caused by gas injected by the vaporizer system will be no more than about one and one-half inches of mercury. Thus the gas injected by the vaporizer can never reduce manifold vacuum sufficiently to adversely affect operation of the PCV valve.

The check valve through which the vapors exit does not open until a pressure differential thereacross is sufficient to overcome spring 72. In the preferred embodiment, the tension of spring 72 should be sufficient to maintain check valve disc 70 seated until a pressure differential of one and one-half inches of mercury is developed thereacross. Therefore, an intake manifold vacuum of at least one and one-half inches of mercury must be developed before the vaporization system is operational. By maintaining a negative pressure in the vaporizer, the fuel is more readily moved through the wicking material and more readily vaporized.

Since the fuel drawn through the vaporization unit is fully vaporized, the carburetor may be adjusted to produce a leaner mixture, resulting in more efficient combustion and cleaner burning of the fuel which substantially lowers hydrocarbon and carbon monoxide emissions. Furthermore, fuel economy is promoted. Maximum efficiency of the vaporization system is obtained when a manifold pressure of about 18 to about 20 inches of mercury is maintained.

Since the vaporizer container and components need not withstand excessive pressures or temperatures, a wide range of materials is suitable for fabrication thereof. In the preferred embodiment, the enclosure, as well as many of the internal components and the check valve housings, may be fabricated from injection molded nylon. This material is inert to gasoline, readily and inexpensively available, and readily forms gas-tight seals. A wall thickness of 0.070 inch is suitable for the container halves 31 and 32 which may be joined together by the tongue and groove arrangement illustrated by suitable fastening means and/or using a conventional O-ring or the like. Various other methods of forming a sealed container will be apparent to those skilled in the art.

From the foregoing it will be readily observed that the system of the invention, when employed with internal combustion engines for vehicular use, significantly increases fuel efficiency while lowering exhaust emissions of hydrocarbons and CO. Furthermore, the system may be readily installed in conventional engines without major modification of the conventional air and fuel mixing system and offers no apparent detrimental effects to operation of the engine. In accordance with the teachings of the invention, the system is completely fail-safe and leak-proof, thereby presenting no additional hazards to operation of the engine and may be readily and inexpensively fabricated and installed using readily available and conventional equipment and materials.

While the invention has been described with particular reference to a specific embodiment thereof, it is to be understood that the form of the invention shown and described in detail is to be taken as the preferred embodiment of same, and that various changes and modifications may be resorted to without departing from the spirit and scope of the invention as defined by the appended claims.

What is claimed:

1. A fuel distribution system comprising:

(a) a carburetor including a throttle valve and connected to the intake manifold of an internal combustion engine;

(b) fuel supply means for supplying fuel to said carburetor including a fuel reservoir, a pump, a first fuel line connecting said reservoir and said pump and a second fuel line connecting said pump and said carburetor;

(c) conduit means connected between said intake manifold downstream from said throttle valve and a PCV valve;

(d) a fuel vaporizer having fuel inlet means, air inlet means and vapor outlet means, said vaporizer comprising:

(i) a top wall, a bottom wall and side walls defining a sealed enclosure;

(ii) a fuel conduit depending internally from the top wall of said enclosure, the lower end of said fuel conduit containing an orifice defining a valve seat, said valve seat being positioned substantially equidistant from said top and bottom walls and a substantial distance from any side wall, the upper end of said fuel conduit communicating with said fuel inlet means;

(iii) float means supporting a needle valve aligned with and adapted for mating with said valve seat and preventing fuel flow therethrough when a predetermined fuel level is contained in the lower portion of said enclosure;

(iv) cage means defining a housing coaxial with said valve seat surrounding the vertical sides of said float means and extending below said predetermined fuel level, thereby preventing lateral movement of said float means with respect to said valve seat and damping vertical movement of said float means;

(v) a body of foraminous material having a relatively high ratio of surface area to volume positioned within said enclosure to cover a substantial portion of said bottom wall and extending above said predetermined fuel level;

(vi) check valve means controlling fluid flow through said vapor outlet means, said check valve means preventing fluid flow into said enclosure through said vapor outlet means and permitting fluid flow from said enclosure through said vapor outlet means only when there is a predetermined pressure differential across said check valve means; and (vii) a divider extending from the top wall of said enclosure to the top surface of said body of foraminous material between said air inlet means and said vapor outlet means whereby all air passing through said vaporizer must pass through said body of foraminous material;

(e) first conduit means for conducting fuel from said first fuel line to said fuel inlet means; and (f) second conduit means for conducting fluid from said check valve into said conduit means connected between said intake manifold downstream from said throttle valve and said PCV valve.

2. A fuel distribution system as defined in claim 1 wherein said body of foraminous material is a body of polyurethane foam.

3. A fuel distribution system as defined in claim 1 including filter means controlling flow through said vapor outlet means which permits only fully vaporized fuel and air to pass therethrough.

4. A fuel distribution system as defined in claim 3 wherein said filter means a porous bronze sponge.

5. A fuel distribution system as defined in claim 1 including outlet means at the bottom of said enclosure, conduit means connected between said outlet means and said first fuel line, and check valve means controlling fluid flow through said outlet means.

6. A fuel distribution system as defined in claim 1 including means for limiting the flow of gas through said second conduit to cause no more than about four inches of mercury increase in manifold pressure of said engine at idle speed.

7. A fuel distribution system as defined in claim 1 including means for limiting the flow of air through said air inlet means to maintain a negative pressure of about two and one-half inches of mercury in said vaporizer during operation of said engine.

8. In a fuel distribution system including a carburetor including a throttle valve and connected to the intake manifold of an internal combustion engine, fuel supply means for supplying fuel to said carburetor and conduit means connected between said intake manifold downstream from said throttle valve and a PCV valve; a fuel vaporizer comprising:

(a) a top wall, a bottom wall and side walls defining a sealed enclosure;

(b) fuel inlet means in fluid communication with said fuel supply means;

(c) means for maintaining a predetermined level of liquid fuel in said vaporizer;

(d) a body of foraminous material partially submerged in said liquid fuel with a portion of said body of foraminous material extending above said liquid fuel;

(e) air inlet means;
(f) vapor outlet means in fluid communication with said conduit means; and
(g) means for causing all air entering said vaporizer through said air inlet means to pass through said portion of said body of foraminous meterial extending above said liquid fuel.

9. A fuel vaporizer as defined in claim 8 including:
(i) drain means in said bottom wall; and
(ii) check valve means permitting liquid fuel to drain from said fuel vaporizer when the pressure exerted on said check valve means exceeds a predetermined value.

10. A fuel vaporizer as defined in claim 8 including:
(i) means for filtering air entering said air inlet means;
(ii) means for limiting the flow of air through said air inlet means to maintain a reduced pressure in said vaporizer when a reduced pressure is applied to said vapor outlet means; and
(iii) means for limiting the flow of gas through said vapor outlet means.

11. In a fuel vaporizer system including a closed container having a fuel inlet, means for maintaining a predetermined level of liquid fuel in said container, an air inlet, a vapor outlet and conduit means connecting said vapor outlet between the intake manifold and the PCV valve of an internal combustion engine; a body of foraminous material having a relatively high ratio of surface area to volume positioned in said container partially submerged in said liquid fuel and partially extending above said predetermined level of liquid fuel and means dividing the space above said foraminous material between said air inlet and said vapor outlet whereby all air passing from said air inlet to said vapor outlet is directed through said foraminous material above the liquid fuel level.

12. The fuel vaporizer system defined in claim 11 and further including:
(a) means for controlling the flow of gas through said vapor outlet to permit no more than about four inches of mercury increase in the manifold pressure of said internal combustion engine when operated at idle speeds; and
(b) means for controlling the flow of air through said air inlet to maintain a reduced pressure in said container when said engine is operating.

13. The method of injecting a mixture of vaporized fuel and air into the intake manifold of an internal combustion engine having an intake manifold, a carburetor, a fuel pump, a fuel reservoir, a first fuel conduit connecting said fuel reservoir and said fuel pump, a second fuel conduit connecting said fuel pump and said carburetor, and a gas conduit connected between said intake manifold and a PCV valve controlling the flow of gas from the engine crankcase to said intake manifold, comprising the steps of:
(a) connecting the fuel inlet of a vaporizer having a fuel inlet, an air inlet, a vapor outlet and means for maintaining a predetermined level of liquid fuel therein to one of said fuel conduits and a body of foraminous material partially submerged in said liquid fuel;
(b) connecting said vapor outlet with said gas conduit connected between said intake manifold and said PCV valve;
(c) controlling the flow of gas through said vapor outlet to permit no more than about four inches of mercury increase in manifold pressure in said intake manifold when said engine is operated at idle speeds; and
(d) controlling the flow of air through said air inlet to maintain a negative pressure in said vaporizer when said engine is operated at idle speeds i.e. directing all air exerting said air inlet through the portion of said foraminous material above said liquid fuel.

14. The method set forth in claim 13 wherein said fuel inlet in connected to said first fuel conduit and the flow of air through said air inlet is controlled to maintain a negative pressure in said vaporizer of about two and one-half inches of mercury when said engine is operated at idle speeds.

* * * * *

UNITED STATES PATENT AND TRADEMARK OFFICE

CERTIFICATE OF CORRECTION

PATENT NO. : 4,270,505
DATED : June 2, 1981
INVENTOR(S) : Randall W. Johnson

It is certified that error appears in the above-identified patent and that said Letters Patent are hereby corrected as shown below:

Column 3, line 14, "cylinder" should read ---cylindrical--- line 45, "a" should read ---an---

Column 4, line 12, "is free" should read ---is a free---

Column 6, line 2, "of liquid" should read ---of the liquid--- line 31, "throught" should read ---through--- line 54, "equiped" should read ---equipped---

Column 7, line 28, "is" should read ---in---

Column 10, line 36, "means a" should read ---means is a---

Column 11, line 6, "meterial" should read ---material---

Column 12, line 32, "i.e." should read ---and--- line 33, "exerting" should read ---entering--- line 37, "in" should read ---is---

Signed and Sealed this

*Twenty-sixth* Day of *January 1982*

[SEAL]

*Attest:*

GERALD J. MOSSINGHOFF

*Attesting Officer* *Commissioner of Patents and Trademarks*